United States Patent [19]

Tokitsu

[11] 4,025,298

[45] May 24, 1977

[54] WALKING BEAM FURNACE FOR ROUND BAR AND THE LIKE

[75] Inventor: Tetsuya Tokitsu, Takarazuka, Japan

[73] Assignee: Midland-Ross Corporation, Cleveland, Ohio

[22] Filed: Nov. 7, 1975

[21] Appl. No.: 630,064

[30] Foreign Application Priority Data

Nov. 8, 1974 Japan ..... 49-129376

[52] U.S. Cl. ..... 432/122; 198/773

[51] Int. Cl.[2] ..... F27B 9/14

[58] Field of Search ..... 198/219, 773, 774, 952; 432/122

[56] References Cited

UNITED STATES PATENTS

| | | | |
|---|---|---|---|
| 1,965,868 | 7/1934 | Vickers | 198/219 |
| 3,373,979 | 3/1968 | Hammond | 432/122 |
| 3,374,996 | 3/1968 | Keough | 432/122 |
| 3,554,505 | 1/1971 | Dessarts | 432/122 |
| 3,693,950 | 9/1972 | Enk | 432/122 |
| 3,850,287 | 11/1974 | Petros | 432/219 |

*Primary Examiner*—John J. Camby

*Attorney, Agent, or Firm*—Frank J. Nawalanic

[57] ABSTRACT

A walking beam furnace for round bars and the like is provided with burners firing above and below the work in a heat zone portion of the furnace to produce a short length furnace, and a refractory hearth downstream of the heat zone portion is provided for work straightening. The hearth is provided with concave inserts having a base portion aligned with the refractory floor to insure bar straightness after heating.

4 Claims, 6 Drawing Figures

WALKING BEAM FURNACE FOR ROUND BAR AND THE LIKE

This invention relates generally to a walking beam furnace and more particularly to a walking beam furnace for heating round bars and the like with provision in the furnace for correcting the deformation of the work which occurs after heating.

The invention is particularly applicable for heating round bars subsequently used in the manufacture of seamless steel pipe and will be described with particular reference thereto. However, it will be appreciated by those skilled in the art that the invention may have broader application and is applicable to any heating operation for round shapes which have a tendency to deform during the heating phase and which must be subsequently straightened.

In the manufacture of seamless steel pipe, a round bar which is the material for the pipe is first heated to 1150°–1250° C in a reheating furnace and then formed into pipe by an extrusion machine. When heating the round bar, it is important to heat the bar uniformly and to prevent it from being deformed. Unless the bar is heated uniformly, the wall thickness of the subsequently formed pipe will be uneven and, in the event the bar is deformed during heating, it becomes difficult to form the pipe. For instance, the deflection (straightness) of a 1 to 5 meter long bar, 40 to 50 millimeters in diameter should be limited to less than 20 millimeters.

Heretofore, such bars have been heat treated in a walking beam, hearth type furnace where the work is conveyed through the furnace by being alternately located on a movable refractory hearth and fixed refractory hearth. Such walking beam furnaces were able to keep the workpieces relatively straight because the work was slowly heated. That is, the furnaces were equipped with burners which fired only over the top of the work. This results in a relatively long length walking beam furnace which is expensive to construct and also, because the work is kept in the furnace a relatively long time, objectionable scale is generated in a relatively large quantity. If such furnaces were modified to provide a faster heating rate which could be accomplished by installing burners firing above and below the work, the walking beam mechanism by alternately raising and lowering the work at different support points in a heated state would result in objectionable thermal deformation of the work.

Another type of furnace employed for heating round bars is a rotary hearth type furnace where the work is located radially on the rotating refractory hearth and is heated completely while the hearth makes one revolution. This type of furnace suffers drawbacks similar to that described for the walking beam furnace above, but, in particular, is limited by the size of the hearth to relatively small length pipe. Additionally, relatively complex charging mechanisms are required to load and unload the furnace.

It is thus an object of the subject invention to provide a furnace of the walking beam type for heating round bars and the like which imparts a relatively fast heat rate to the bar to avoid or minimize scale deposition thereon while also incorporating work shape correction means to insure straightness of the bar after heating.

In accordance with the invention, this object along with other features of the subject invention is achieved by providing a walking beam furnace comprising a heat zone portion adjacent the furnace entrance end and a soak zone portion adjacent the exit end. The refractory floor of the furnace is vertically offset so as to provide a space below the work in the heat zone portion of the furnace and a refractory hearth in the furnace soak zone. To provide a relatively fast heating rate, burners firing above and below the work are provided in the heat zone portion. Work transfer pitch securing means are then provided in the hearth or the soak zone portion which corrects thermal deformation of the work which occurred in the heat zone.

The work transfer pitch securing means takes a configuration of a scalloped design and, in particular, concave inserts. The inserts are secured to both stationary and movable rails of the walking beam mechanism in both the heat and soak zones and, in particular, are secured to the stationary rails embedded in the hearth and positioned in the hearth so that the base portion is aligned with the refractory of the hearth. The inserts therefore provide not only a means for holding the work in a rotatable manner as the round work is walked through the furnace, but also permit the entire length of the work to contact the refractory hearth in the soak zone in a rotatable manner as the work is walked therethrough thereby insuring against deformation of the round bar.

The invention may take physical form in certain parts and arrangement of parts, a preferred embodiment of which will be described in detail herein and illustrated in the accompanying drawing which forms a part hereof and wherein.

Figure 1:
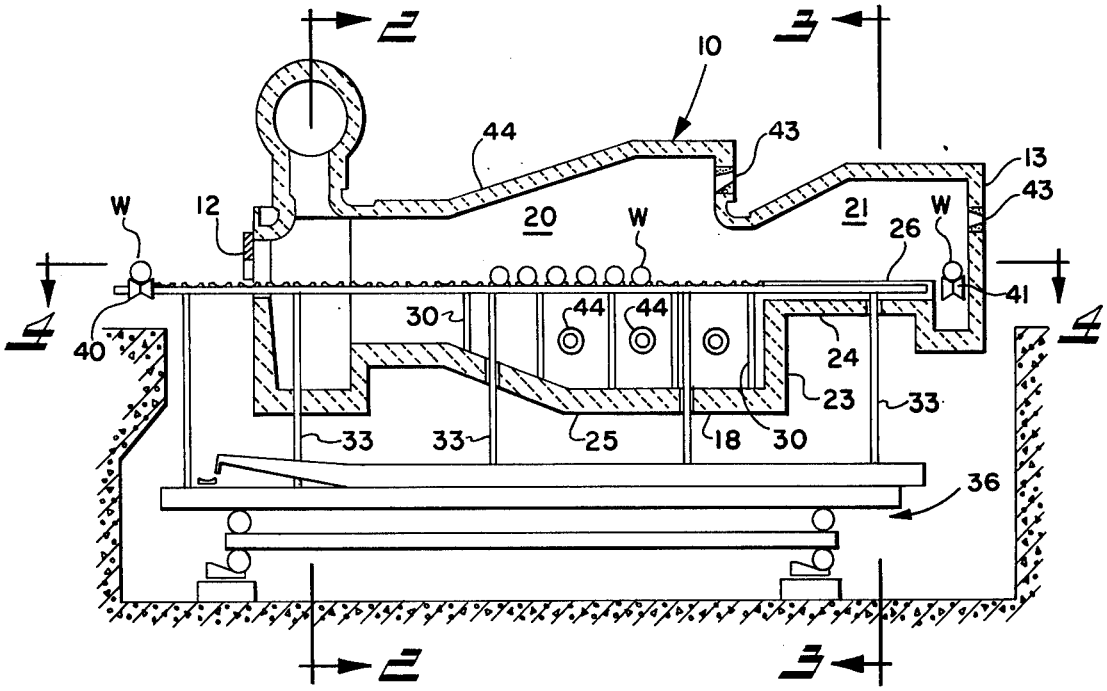
FIG. 1 is a longitudinal, cross-sectional, schematic-type view of a walking beam furnace.
Figure 2:
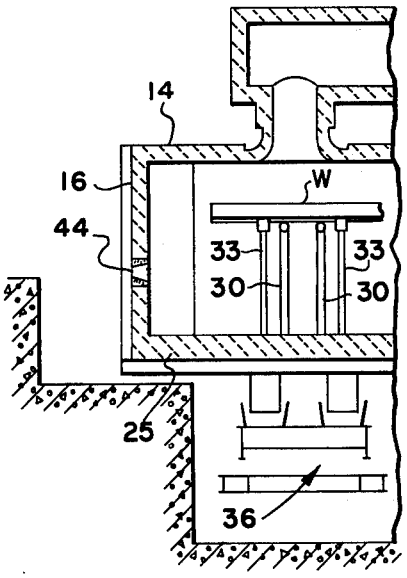
FIG. 2 is a cross-sectional view of the furnace taken along lines 2—2 of FIG. 1.
Figure 3:
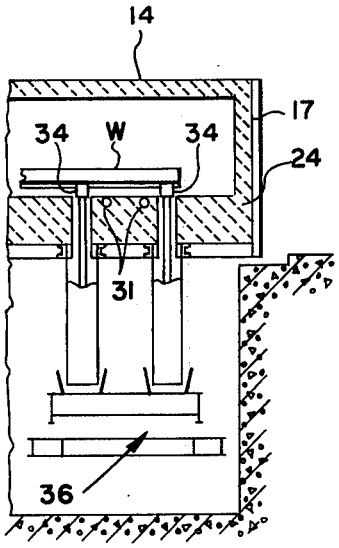
FIG. 3 is a cross-sectional view of the furnace taken along lines 3—3 of FIG. 1 and similar to that of FIG. 2.

Referring now to the drawing wherein the showings are for illustrating a preferred embodiment of the invention only and not for the purpose of limiting same, there is shown in FIG. 1 a walking beam furnace 10 having an entrance end wall 12, an exit end wall 13, a roof 14, sidewalls 16, 17 (FIG. 4) and a floor 18 collectively defining an insulated, longitudinally extending enclosure. The enclosure as shown in FIG. 1 is divided into a heat zone portion 20 and a soak zone portion 21. Floor 18 is vertically offset as at 23 to define a soak floor or hearth portion 24 in soak zone portion 21 having a top hearth surface 26 displaced vertically upwards from a heat floor portion 25 in heat zone portion 20.

Figure 4:
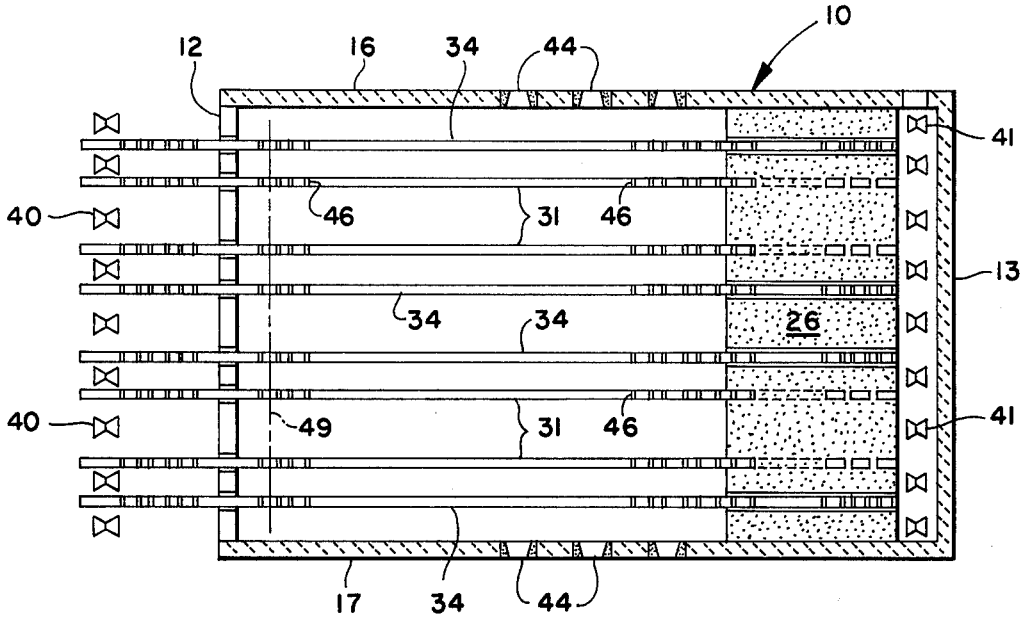
FIG. 4 is a plan, cross-sectional view of the furnace taken along lines 4—4 of FIG. 1.

The longitudinal round bar work identified as "W" in the drawing is conveyed through the furnace by a typical type walking beam mechanism known to those skilled in the art and thus shown only diagrammatically in the drawing and described only in a general sense. The walking beam mechanism includes stationary, vertically extending posts 30 suitably secured to heat floor portion 25. Secured to the top of each longitudinal row of stationary posts 30 is a longitudinally extending stationary rail 31, there being four such rails in the furnace illustrated (FIG. 4). In the embodiment disclosed, each stationary rail 31 is embedded in soak floor portion 24 although it should be clear to those skilled in the art that the stationary rails need not extend into soak floor portion 24. Furnace floor 18 is provided with a plurality of sealed openings extending throughout its length through which vertically extend a plurality of movable posts 33. Secured to the top of each longitudinally aligned array of movable posts 33 is a longitudinally extending movable rail 34 (there being four such rails illustrated) and movable rails 34 extend throughout the furnace length (FIG. 4). Secured to the bottom of movable posts 33 is an appropriate lift or drive mechanism 36 shown to be a conventional wedge-roller drive which may impart to movable rails 34 either rectangular, circular or elliptical motion through movable posts 33. Other known lift arrangements, such as any of those shown or disclosed in U.S. Pat. Nos. 2,235,771; 2,580,114; 3,451,532 or 3,820,946, may be supplied in place of the lift mechanism 36 illustrated. The walking beam mechanism operates in a conventional fashion to drop the movable rails below the elevation of the stationary rails, carry the movable rails forward, lift the movable rails above the elevation of the stationary rails to contact the work W, and lift the work above the stationary rails and carry the work towards the rear of the furnace whereupon the movable rails dip below the stationary rails causing the work to rest on the stationary rails and the cycle is started over again.

Means are provided for transferring the work W into the furnace and conveying the work from the furnace which includes conveyor transfer rolls 40, 41 adjacent the furnace entrance and exit ends respectively. Rolls 40, 41 are situated so that movable rails 34 will lift the work W from the entrance rolls 40 and place the work W on stationary rails 31 and similarly movable rails 34 will lift work W and place same on exit conveyor rolls 41. Furnace 10 is also provided with top firing burners 43 located in furnace roof 14 firing above the work in both heat and soak zone portions 20, 21 and bottom firing burners 44 located in sidewalls 16, 17 firing below the work in heat zone portion 20. Other burner arrangements which produce top firing in heat and soak zones 20, 21 and bottom firing in heat zone 20 will suggest themselves to those skilled in the art.

It should be clear that if movable and stationary rails 34, 31 were flat at their top surfaces, the motion of the walking beam mechanism will result in the round work W rolling from the entrance end of the furnace to the exit end. To prevent this from occurring and for other reasons to be explained later, both stationary and movable rails 31,34 (and soak floor portion 24 if not provided with a stationary rail portion embedded therein) are formed with a scallop pattern on the top thereof. In the embodiment shown in FIGS. 5 and 6, the scallop form is accomplished by concave inserts 46 or work transfer pitch securing means secured at equal increments by spacers 50 to movable and stationary rails 34, 31 throughout the furnace length. Inserts 46 for both the movable and stationary rails are located so as to be aligned laterally or across the width of the furnace with one another at some point during the travel of the walking beam mechanism (FIG. 4).

Figure 5:
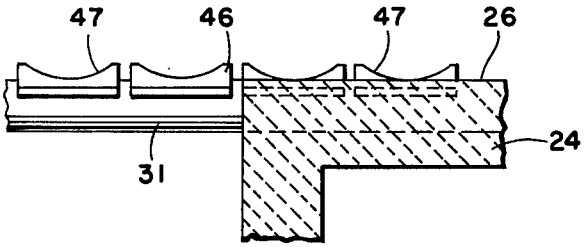
FIG. 5 is a partially enlarged view of a longitudinal portion of the furnace shown in FIG. 1.
Figure 6:
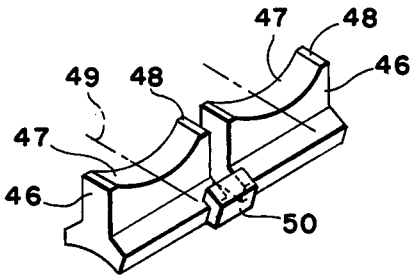
FIG. 6 is a perspective view of an example of the work transfer pitch securing means of the subject invention.

Inserts 46 are defined by a concave portion 47 extending downwardly from flats 48 machined or formed at the edges of insert 46, flats 48 providing a smooth transition into concave portion 47 in the event the work W is contacted between two inserts 46. Concave portion 47 is defined by a radius or radii which is at least as great as the radius of the work to be treated in the furnace and preferably greater. Importantly, the base or apex of concave portion 47 as defined by centerline 49 in FIG. 6 is tangential to or in alignment with top surface 26 of the refractory defining soak floor portion 24 as shown in FIG. 5. If furnace 10 were constructed with stationary rails 31 not embedded in soak floor portion 24, inserts 46 would be formed of refractory or ceramic brick in soak floor portion 24 at the same elevation with respect to the floor and with respect to the scallop design on stationary rail 31 as shown in FIG. 5.

In operation, the work conveyed to entrance conveyor rolls 40 is lifted from rolls 40 and conveyed or walked through furnace 10 by the walking beam mechanism. As movable rails 34 pick the work from stationary rails 31 and set the work back down onto the stationary rails, the work is prevented from rolling through the furnace by inserts 46 and is also permitted to rotate through a slight angle as the work enters and leaves the insert. Since the work rotates slightly as it is deposited or picked up in concave portions 47 of successive inserts 46, uniform heating of the work occurs. The top and bottom burner firing arrangement in heat zone portion 20 will heat the work W relatively quickly to its desired temperature and avoid or minimize scale formation. However, the rapid heating rate will cause the work to deform since the work is alternately supported between the points defined by stationary and movable rails 31, 34. This work deformation will be subsequently corrected in soak zone portion 21 of the furnace. When the work enters furnace soak zone portion 21, the geometrical relationship between inserts 46 and refractory soak floor portion 24 will establish at least line contact over the length of the entire workpiece with the refractory of the soak floor portion 24. This will equalize the temperature of the work along the line contact and tend to straighten the work about the line contact. When the work is transferred to the next insert in the refractory soak zone portion, the rolling of the work within insert 46 will establish yet another line contact with the refractory of soak floor portion 24 which will thus tend to straighten the work about that line contact.

The invention has been described with reference to a preferred embodiment. Obviously, modifications and alterations will occur to others upon reading and understanding the specification. It is my intention to include all such modifications and alterations insofar as they come within the scope of the present invention.

It is thus the essence of the invention to provide a walking beam furnace for rapidly heating round bar work and the like by means of a burner arrangement which will cause deformation of the work, which work is subsequently straightened or cured by work transfer pitch securing means provided in the furnace.

Having thus defined the invention, I claim:

1. A furnace for heating elongated round workpieces such as round bar and the like comprising:

a floor, a roof, sidewalls, an entrance end wall and an exit end wall defining a longitudinally-extending enclosure having a heat zone portion adjacent said entrance end wall and a soak zone portion adjacent said exit end wall, said floor having a heat portion and a refractory soak portion offset vertically from said heat portion, said floor further having a plurality of longitudinally spaced openings extending therethrough;

a plurality of stationary posts extending vertically-upward from said floor in said heat zone portion, and a plurality of stationary rails secured to said stationary posts and extending longitudinally at least the length of said heat zone portion, the topmost portion of said stationary rails being approximately level with said soak portion of said floor;

a plurality of movable posts extending vertically-upward through said floor openings, a plurality of movable rails secured to said movable posts and extending the length of said enclosure, lift means attached to the bottom of said movable posts for raising, lowering and moving said movable rails with respect to said stationary rails to cause movement of said work through said enclosure;

burner means in said enclosure operable to directly fire above and below said workpieces in said heat zone at a rate sufficient to thermally deform the straightness of said workpieces and directly fire above said workpieces in said soak zone; and work transfer pitch securing means secured to said rails and formed in said soak floor portion for containing said workpieces as they are walked through said enclosure while insuring line contact of said workpieces with said soak floor portion over substantially the length of said workpieces for substantially straightening any deformation of said workpieces.

2. The furnace of claim 1 wherein:

said movable rails extend through and are embedded in said floor soak portion, and said work transfer pitch securing means includes a plurality of concave inserts affixed at equal distances to the top surfaces of said movable and stationary rails.

3. The furnace of claim 2 wherein:

said concave surfaces have a base portion which is tangential to the top surface of said refractory soak portion of said floor.

4. A walking beam furnace for heating elongated round workpieces such as round bar and the like comprising:

an insulated, longitudinally extending enclosure having an entrance end and an exit end and defined in part by a refractory floor having an offset soak portion adjacent said exit end, said enclosure having a heat zone portion generally adjacent said entrance end and a soak zone portion generally adjacent said exit end;

walking beam means in said enclosure including movable rails throughout the enclosure and stationary rails in at least said heat zone portion for conveying said workpieces in stepwise fashion through said furnace, said stationary rails being in general alignment with said floor soak portion;

burner means in said enclosure operable to directly fire above and below said rails in said heat zone portion at a heating rate sufficient to thermally deform the straightness of said workpieces and above said rails in said soak zone; and a plurality of scalloped inserts formed at the top of said rails in aligned arrays and extending at the same elevation into said floor soak portion, each scallop being generally concave and having a base portion, said base portion of the scallop in said floor soak portion being in alignment with said floor soak portion so that said workpieces are substantially in engagement with and are straightened in said soak zone portion.

* * * * *